United States Patent [19]

Bridges et al.

[11] Patent Number: 4,646,277

[45] Date of Patent: Feb. 24, 1987

[54] CONTROL FOR GUIDING A BORING TOOL

[75] Inventors: Jack E. Bridges, Park Ridge; Joseph O. Enk, Lake in the Hills, both of Ill.

[73] Assignee: Gas Research Institute, Chicago, Ill.

[21] Appl. No.: 722,807

[22] Filed: Apr. 12, 1985

[51] Int. Cl.[4] ..... F21B 44/00; F21B 47/022; B23Q 5/00

[52] U.S. Cl. ..... 367/191; 340/854; 33/304; 166/65.1; 173/4; 175/24; 175/26; 324/346

[58] Field of Search ..... 33/304, 313, 302; 166/65 M, 66; 173/2, 4; 175/24, 26, 45, 62; 324/345, 346; 367/25, 76, 81, 191; 340/854, 855

[56] References Cited

U.S. PATENT DOCUMENTS

| | | | |
|---|---|---|---|
| 3,137,483 | 6/1964 | Zinkiewicz et al. | 262/1 |
| 3,141,512 | 7/1964 | Gaskell et al. | 175/26 |
| 3,326,008 | 6/1967 | Baran et al. | 61/72.5 |
| 3,375,885 | 4/1968 | Scott et al. | 175/26 |
| 3,465,834 | 9/1969 | Southworth, Jr. | 173/2 |
| 3,474,873 | 10/1969 | Zygmunt | 175/19 |
| 3,525,405 | 8/1970 | Coyne et al. | 175/19 |
| 3,529,682 | 9/1970 | Coyne et al. | 175/45 |
| 3,554,301 | 1/1971 | Adkins et al. | 175/24 |
| 3,589,454 | 6/1971 | Coyne | 175/26 |
| 3,630,295 | 12/1971 | Coyne et al. | 175/73 |
| 3,656,161 | 4/1972 | MacPherson | 343/100 PE |
| 3,656,563 | 4/1972 | Blinne | 175/22 |
| 3,677,354 | 7/1972 | Kostylev et al. | 175/76 |
| 3,712,391 | 1/1973 | Coyne | 175/26 |
| 3,853,185 | 12/1974 | Dahl et al. | 175/45 |
| 4,054,881 | 10/1977 | Raab | 343/112 R |

OTHER PUBLICATIONS

Sibilia, J. T., "Mole-A Guided Tunnelling Device," The Edison Electric Institute, Cleveland, Ohio, Oct. 13, 1972.

*Primary Examiner*—Charles T. Jordan
*Assistant Examiner*—Brian S. Steinberger
*Attorney, Agent, or Firm*—Fitch, Even, Tabin & Flannery

[57] ABSTRACT

A control system guides a boring tool in a borehole. The tool has a longitudinal tool axis and includes a driver for advancing the tool axially through the earth and steering mechanism for directing the motion of the tool relative to the tool axis in response to control signals. The control system includes an axial electromagnetic source for generating an axial alternating magnetic field directed along an axial source axis. A sensing assembly remote from the source means includes first and second pickup coils for sensing the alternating magnetic field. Each of the first and second pickup coils has a respective coil axis and is rigidly mounted in respect to the other with their respective axes at a substantial angle with respect to each other, defining a sensing assembly axis substantially normal to both coil axes. Each coil generates a respective null electrical signal when the lines of magnetic flux at the respective coil are normal to the respective coil axis. Either the source of the sensing assembly is rigidly mounted on the tool, preferably the source. The outputs of the sensing coils are used to determine the direction of lines of magnetic flux at the sensing assembly, and indicate the attitude of the source relative to the sensing assembly. This permits guiding of the tool by control signals sent to the tool.

11 Claims, 7 Drawing Figures

CONTROL FOR GUIDING A BORING TOOL

BACKGROUND OF THE INVENTION

The present invention relates generally to the boring of horizontal holes and, more particularly, to the guiding of a horizontal boring tool. Still more particularly, the present invention relates to the control of the guidance of such a tool, especially using a magnetic sensing system for sensing tool location and attitude.

The present invention has particular application in the installation of conduits and pipes by various utilities, such as gas, telephone and electric utilities. Such utilities are often faced with the need to install or replace such conduits or pipes under driveways, roads, streets, ditches and/or other structures. To avoid unnecessary excavation and repair of structures, the utilities use horizontal boring tools to form the bore holes in which to install the conduits or pipes. Such tools have been unsatisfactory to the extent that their traverse has not been accurate or controllable. All too frequently other underground utilities have been pierced or the objective target has been missed by a substantial margin. It has also been difficult to steer around obstacles and get back on course.

The directional drilling of holes has probably reached its greatest sophistication in the oil fields. Typical well surveying equipment utilizes magnetometers, inclinometers and inertial guidance systems which are complex and expensive. The wells drilled are substantially vertical. In respect to utilities, Bell Telephone Laboratories Incorporated has designed a system for boring horizontal holes wherein the direction of drilling is controlled by deploying a three wire antenna system on the surface of the earth and detecting the position and attitude of the drilling tool in respect thereto by pickup coils on the tool. The signals detected are then used to develop control signals for controlling the steering of the tool. See, for example, MacPherson U.S. Pat. No. 3,656,161. Such control systems have been relatively expensive, and it is not always easy or convenient to deploy the antenna, for example, over a busy highway.

Steering control is also known in controlling vehicles, aircraft and missiles. In one form of control, a radio beacon is used for guidance, the aircraft simply following a beacon to a runway.

SUMMARY OF THE INVENTION

The present invention may be used with various boring tools. The preferred embodiment was designed for a piercing tool advanced by percussion and steered by active and passive vanes. In accordance with the invention, a coil is disposed on the tool and energized at relatively low frequency to provide a varying magnetic field extending axially from the tool and providing lines of magnetic flux substantially symmetrically disposed about the tool axis. First and second pickup coils are disposed at a distance from the tool. These coils have respective axes at a substantial angle with respect to each other and are mounted to sense the changing flux linked thereby and produce respective first and second electrical signals. The coil arrangement provides respective null signals when the respective axes of the pickup coils lie substantially perpendicular to the tool axis and the coils are balanced about the tool axis. The signals therefore indicate the attitude of the tool relative to the coils. A third pickup coil may be used to sense the range of the tool when the third coil has an axis extending generally toward the tool, with its output used to normalize the detection signals. The axes of the three coils are preferably at angles of 90° from each other.

The signals from the respective pickup coils may be used to determine the attitude of the tool relative to the pickup coils, and the information used to control the steering mechanism of the tool. This may be done automatically. Because this is a null-based system, the control signal may simply operate the steering mechanism to turn the tool to reduce the deviation from null. This causes the system to be a homing device, like a beacon, and directs the tool along a path to the coils. On the other hand, it may be desirable to deviate from a straight path, as to miss obstacles. The system may then direct the tool out of the path, around an obstacle, and back on course.

Thus, an important aspect of the present invention is to provide a null detection system to determine the attitude of a horizontal boring tool relative to detection coils and for controlling the steering of the tool. Another aspect is to provide a control system for such a tool wherein the tool may be steered to home in on the detection coils. Other aspects, objects and the advantages of the present invention will become apparent from the following detailed description, particularly when taken in conjunction with the accompanying drawings.

DETAILED DESCRIPTION OF PREFERRED EMBODIMENTS

Figure 1:
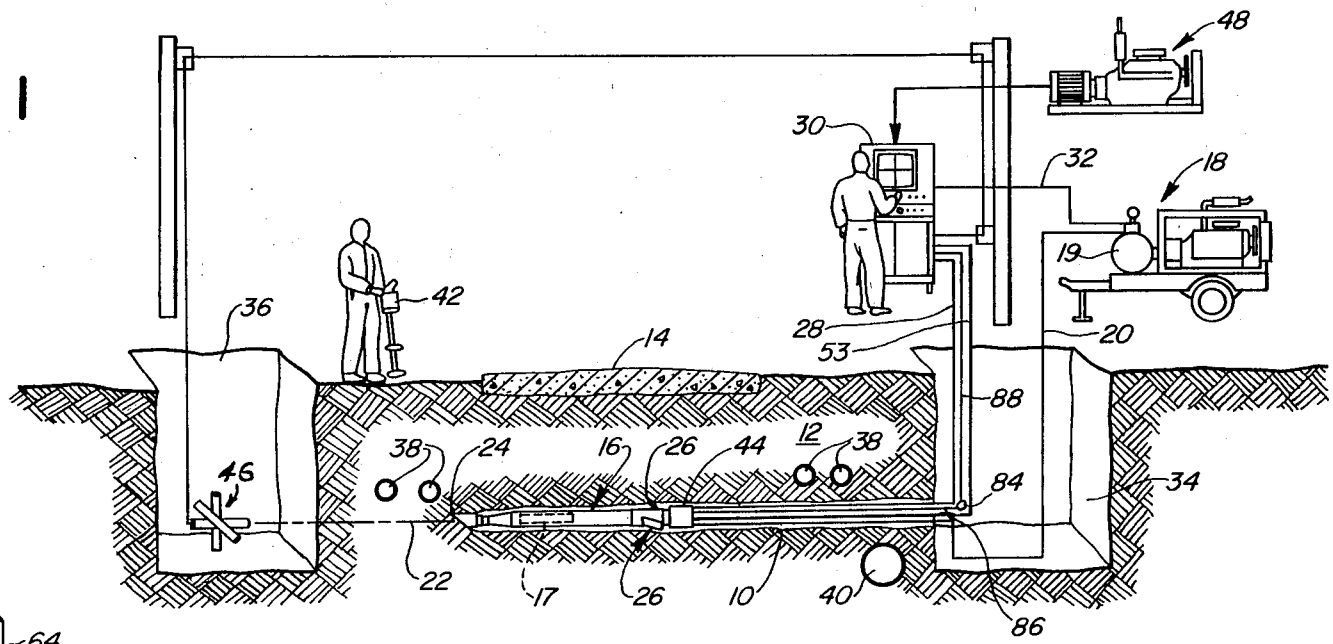
FIG. 1 is a vertical sectional view, partly diagrammatic and partly in perspective, of a horizontal boring operation, showing a horizontal boring tool controlled by a control system according to the present invention.

In FIG. 1 is illustrated a horizontal boring operation in which a borehole 10 is being bored through the earth 12 under a roadway 14 by a horizontal boring tool 16. The particular tool illustrated and for which the preferred embodiment of the present invention was specifically designed is a pneumatic percussion tool, operated like a jackhammer by a motive mechanism 17 using compressed air supplied by a compressor 18 by way of an air tank 19 over a supply hose 20. The tool 16 is elongated and has a tool axis 22 extending in the direction of its length. The lead end of the tool 16 has a piercing point (or edge) 24 eccentric of the axis 22. The operation of the percussion tool drives the point 24 through the earth, advancing the tool forward, but slightly off axis.

The tool 16 includes a plurality of steering vanes 26 which may be actuated by pneumatic or hydraulic control energy provided over pneumatic or hydraulic control lines 28 from a controller 30 to control the direction and rate of rotation of the tool 16 about its axis. Control signals may also control the operation of the motive mechanism 17. The controller 30 is supplied with air from the compressor 18 over a hose 32. The steering vanes 26 may be turned to cause the tool to rotate at a relatively constant rate. The tool then spirals a bit but advances in a substantially straight line in the direction of the axis 22 because the piercing point 24 circles the axis and causes the tool to deviate the same amount in each direction, averaging zero. If the vanes 26 are returned to directions parallel to the axis 22, the rotation may be stopped with the tool in a desired position, from which it advances asymmetrically in a desired direction. As will be described below, the present invention permits an operator to identify the rotational orientation of the tool 16 about its axis 22 and, hence, to direct the advance of the tool.

The objective is to bore a hole 10 relatively horizontally between an input pit 34 and a target pit 36 beneath such obstacles as the roadway 14. The hole 10 must avoid piercing other utility lines 38 or sewers 40 or other buried obstacles. These may be identified and located from historical surveyor's drawings or may be located by some other means as by a metal detector or other proximity device 42. Armed with this information, an operator may start the tool off easily enough from the input pit 36 in a direction that avoids nearby obstacles and may plot a course that would miss all more distant obstacles. The difficulty is in assuring that the tool follows the plotted course. That is the function of the present invention.

The present invention is directed to a control system for sensing the attitude of the tool 16 and for controlling the steering vanes 26 to direct the tool along the plotted course. The control system includes an electromagnetic source 44 affixed to the tool 16 for generating appropriate alternating magnetic flux, a sensing assembly 46 disposed in one of the pits 34, 36, preferably the target pit 36, and circuitry in the controller 30 which is powered from a motor-generator set 48.

Figure 2:
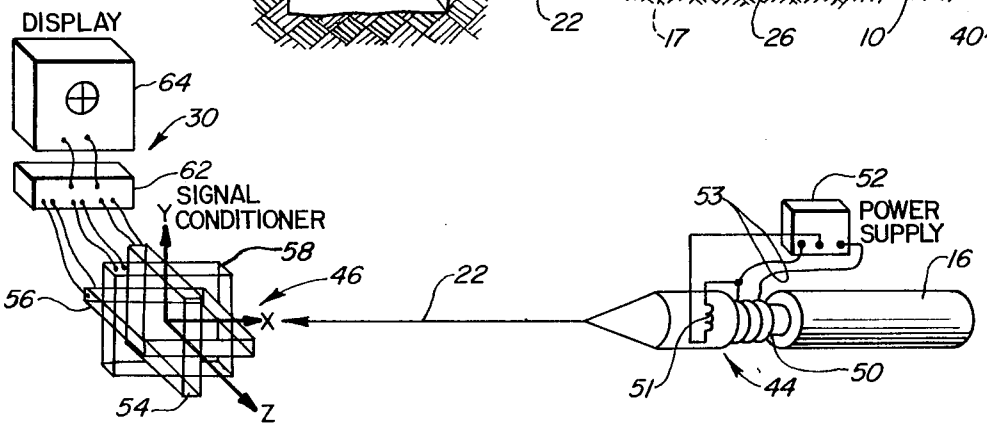
FIG. 2 is a diagrammatic illustration of the sensing system of the control system of the present invention.

Reference may be made to FIG. 2 for an understanding of the preferred arrangement of the electromagnetic source 44 and the sensing assembly 46. The electromagnetic source 44 comprises an axial coil 50 and a transverse coil 51 rigidly mounted on the tool 16. The coils 50 and 51 are alternatively energized from the motor-generator power source 48 through a controlled power supply section 52 of the controller 30 over lines 53. The power source 48 operates at a relatively low frequency, for example, 20 Hz. The axial coil 50 generates an axial alternating magnetic field which produces lines of magnetic flux generally symmetrically about the axis 22 of the tool 16, as illustrated in FIG. 3. The tool 16 itself is constructed in such manner as to be compatible with the generation of such magnetic field and, indeed, to shape it appropriately. The transverse coil 51 generates a transaxial alternating magnetic field substantially orthogonal to the axis 22 in fixed relation to the direction of deviation of the point 24 from the axis 22 and, hence, indicative of the direction thereof.

Figure 4:
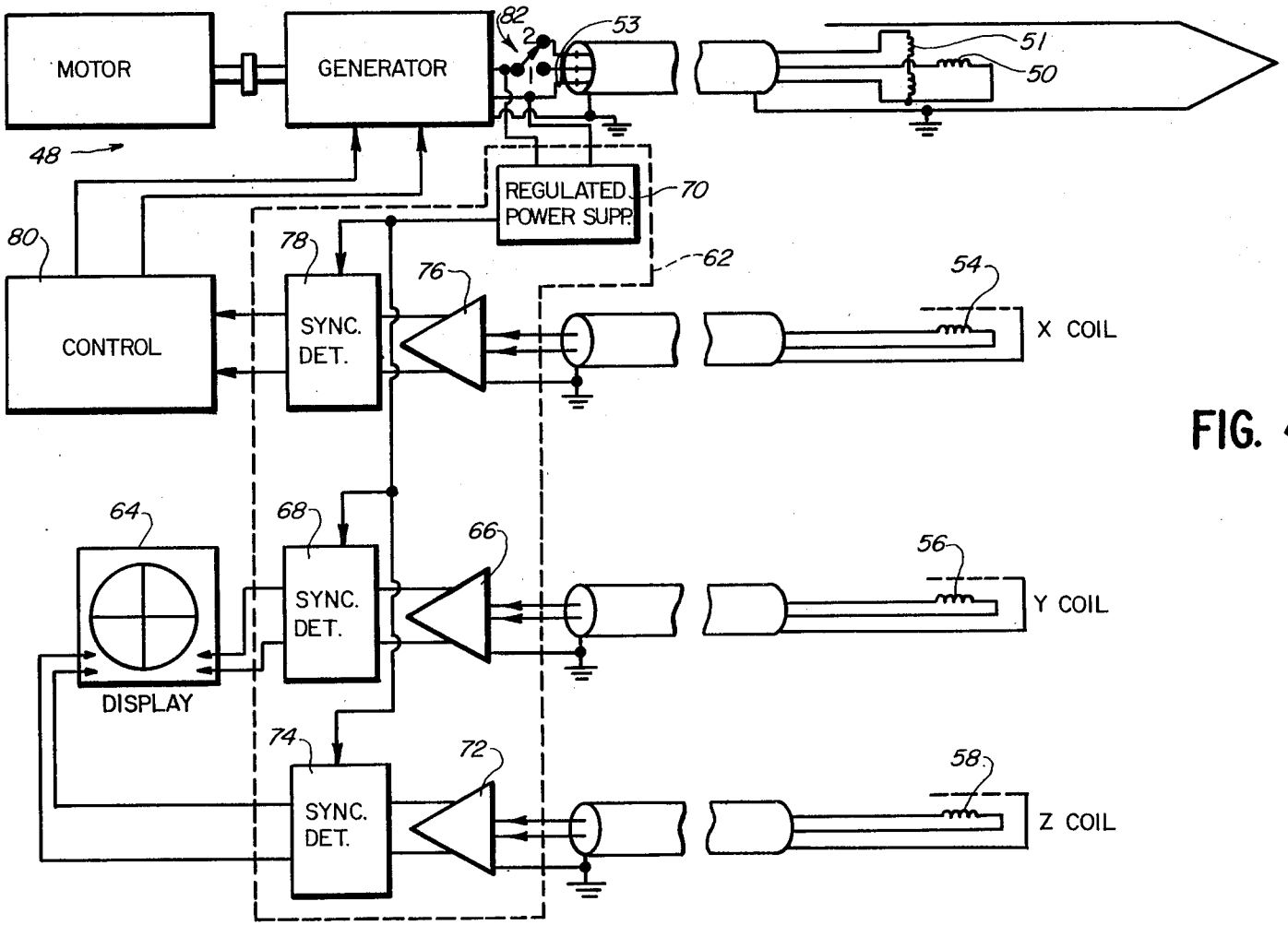
FIG. 4 is a diagrammatic illustration of the electrical circuitry of the sensing system shown in FIG. 2.

The sensing assembly 46 is formed of three orthogonal pickup coils 54, 56 and 58, as shown in FIGS. 2 and 4, which may be called the X, Y and Z coils, respectively. These pickup coils are axially sensitive and can be of the box or solenoidal forms shown in FIGS. 2 and 4. The center of the coils may be taken as the origin of a three-dimensional coordinate system of coordinates x, y, z, where x is the general direction of the borehole, y is vertical and z is horizontal. The coils 54, 56 and 58 have respective axes extending from the origin of the coordinate system in the respective x, y and z directions.

Figure 3C:
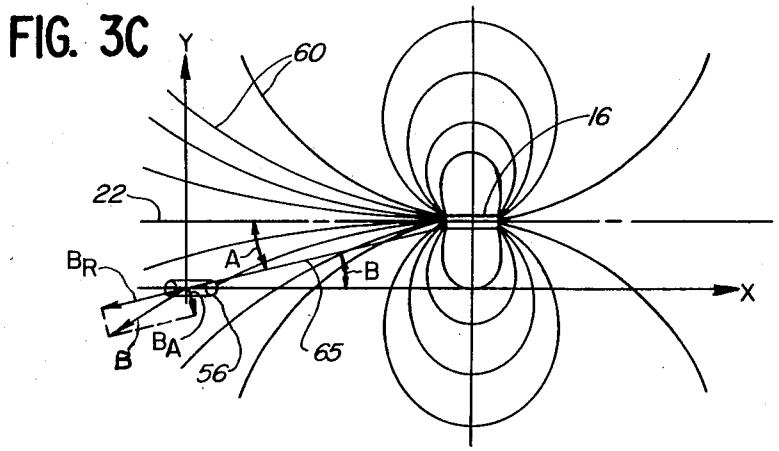
FIGS. 3A, 3B, 3C and 3D are diagrammatic illustrations of relationships of one sensing coil and the magnetic flux generated by the flux generator of the sensing system shown in FIG. 2.
Figure 3D:
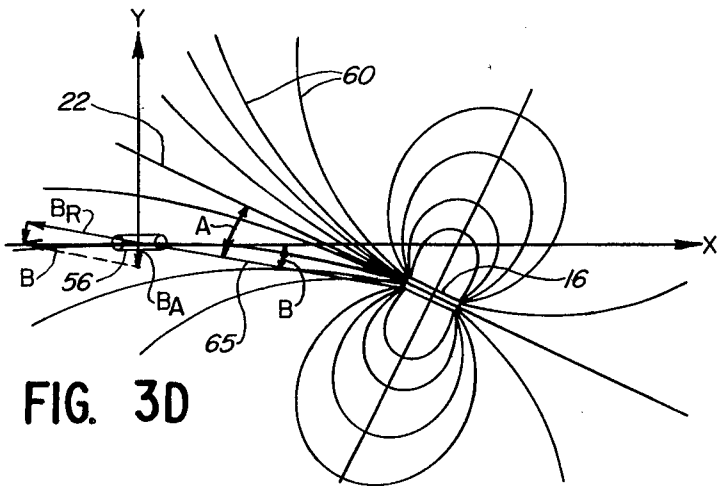
Figure 3A:
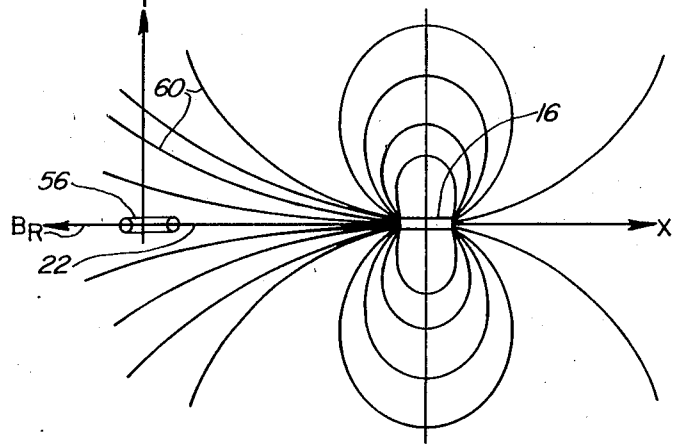
Figure 3B:
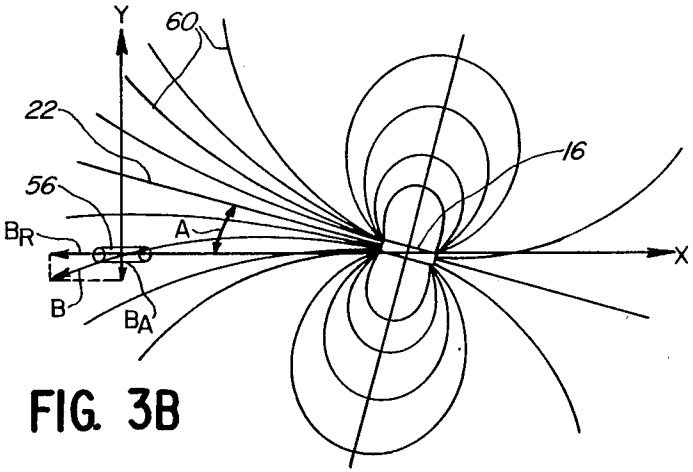

In FIGS. 3A, 3B, 3C and 3D are illustrated four possible unique relationships of a sensing coil, the Y coil 56 as an example, to the lines of flux 60 of the axial magnetic field generated by the axial coil 50 in the tool 16. In FIG. 3A is shown the relationship when the X axis and the tool axis 22 lie in the same plane with the Y axis of the coil 56 normal to that plane. That is the relationship when the tool 16 lies on the plane XZ (the plane perpendicular to the Y axis at the X axis) with the axis 22 of the tool in that plane. In FIG. 3B is shown the relationship when the tool 16 lies in the plane XZ with the tool axis 22 not in that plane. That is the relationship when the tool 16 is tilted up or down (up, clockwise, in the example illustrated). In FIG. 3C is shown the relationship when the tool 16 is displaced up or down from the plane XZ (up, in the example illustrated) with the tool axis 22 parallel to the plane XZ. Other relationships involve combinations of the relationships shown in FIGS. 3B and 3C; that is, where the tool 16 lies off the XZ plane and has a component of motion transversely thereof. Shown in FIG. 3D is the relationship where the combination of displacement (FIG. 3C) and tilting (FIG. 3B) places the coil axis Y normal to the lines of flux 60 at the coil. The lines of flux shown in FIGS. 3A, 3B, 3C and 3D are for conditions when the tool axis 22 lines lies in the XY plane (containing the X and Y axes), but the principle is the same when the tool lies out of such plane. The lines of flux linking the Y coil 56 would be different, and the relative signals would be somewhat different. There would, however, still be positions of null similar to those illustrated by FIGS. 3A and 3D.

As can be seen by inspection and from the principle of symmetry, the pickup coil 56 will generate no signal under the condition shown in FIG. 3A because no flux links the coil. On the other hand, under the conditions of FIGS. 3B and 3C, signals will be generated, of phase dependent upon which direction the magnetic field is tilted or displaced from the condition shown in FIG. 3A. Further, under the condition shown in FIG. 3D, the effect of displacement in one direction is exactly offset by tilting so as to generate no signal. As may also be seen from FIG. 3D, if the tool 16 is off course (off the XZ plane) but the relationship shown in FIG. 3D is maintained, the tool will move toward the sensing assembly 46 keeping the sensing assembly on a given line of flux 60. That is, the tool 16 will home in on the sensing assembly 46 and get back on course in respect to vertical deviation. Similar relationships exist in respect to the Z coil 58 and horizontal deviation. The outputs of the pickup coils 56, 58 are applied through a signal conditioner 62 to a display 64 in the controller 30.

The relationships shown in FIG. 3 can also be analyzed geometrically as shown in FIG. 3, where A is the angle between the tool axis 22 and a line 65 connecting the center of the tool with the center of the pickup coil 56, and B is the angle between the line 65 and the reference axis X, perpendicular to the axis Y of the sensing coil 56.

The well known equation for radial flux density $B_R$ and angular flux density $B_A$ are:

$$B_R = 2\,K_1 \cos A \tag{1}$$

$$B_A = K_1 \sin A \tag{2}$$

where $K_1$ is a constant proportional to the ampere-turns for the axial coil 50 and inversely proportional to the cube of the distance between the tool 16 and the sensing coil 56. The signal V thereupon developed in the pickup coil 56 is proportional to the sum of flux components parallel to the coil axis Y. That is, $$V=K_2(B_R \sin B+B_A \cos B) \quad (3)$$

where $K_2$ is a calibration factor between the developed pickup voltage and time-rate-of-change of the magnetic field. From the combination of Equations (1), (2) and (3):

$$V=K_3(2 \cos A \sin B+\sin A \cos B) \quad (4)$$

when $K_3=K_1K_2$. As is evident from FIG. 3D, when the flux at the coil 56 is normal to its axis Y, the two components balance, i.e., $B_R \sin B=-B_A \cos B$, making $V=O$.

The circuitry for operating the present invention is shown in greater detail in FIG. 4 in block diagram form. As there shown, the output of the pickup coil 56 is amplified by an amplifier 66 and applied to a synchronous detector 68 to which the output of a regulated power supply 70 is also applied. The regulated power supply 70 is driven by the same controlled power supply 52 that drives the coils 50, 51 and produces an a.c. voltage of constant amplitude in fixed phase relationship to the voltage applied to the axial coil 50. In the simplified diagram of FIG. 4, the power supply 52 may be considered as part of the motor-generator 48, although in fact it is preferably located in the controller 30, as stated above. The synchronous detector 68 therefore produces a d.c. output of magnitude proportional to the output of the Y coil 56 and of polarity indicative of phase relative to that of the power supply 70. An amplifier 72 and a synchronous detector 74 produce a similar d.c. output corresponding to the output of the Z coil 58. The outputs of the respective synchronous detectors 68 and 74 are applied to the display 64 which displays in y, z coordinates the combination of the two signals. This indicates the direction or attitude the tool is off course, permitting the operator to provide control signals over the control lines 28 to return the tool to its proper course or to modify the course to avoid obstacles, as the case may be.

The extent to which the tool is off a course leading to the target is indicated by the magnitude of the signals produced in the coils 56 and 58. However, the magnitude of the respective signals is also affected by the range of the tool. That is, the farther away the tool, the lesser the flux density and, hence, the lesser the signals generated in the respective pickup coils 56 and 58 for a given deviation. It is the function of the X coil 54 to remove this variable. The X coil is sensitive to axial flux density substantially exclusively. The y and z directed flux components have negligible effect on its output where the tool 16 lies within a few degrees of the x direction; e.g., 3°. The signal from the pickup coil 54 is amplified by an amplifier 76 and detected by a synchronous detector 78 to provide a d.c. output proportional to the flux density strength at the X coil 54. This signal is applied to a control circuit 80 which provides a field current control for the power supply 52. This provides feedback to change the power applied to the axial coil 50 in such direction as to maintain constant the output of the X coil 54. This makes the flux density at the sensing assembly 46 relatively constant, thus normalizing the outputs of the Y and Z coils 56, 58 and making their outputs relatively independent of range. However, if wide deviations from direct paths between the launch and exit points are expected, the total magnitude of the magnetic flux density should be used for this normalizing function. This magnitude may be developed by appropriately combining the outputs from the three pickup coils.

It is one thing to know where the tool is and its attitude. It is another to return it to its course. That is the function of the transverse coil 51. The power from the power supply 52 is applied to the tool 16 through a switch 82. With the switch 82 in position 1, the axial coil 50 is energized, providing the mode of operation explained above. With the switch 82 in position 2, the transverse coil 51 is energized instead. The resulting magnetic field is substantially orthogonal to that provided by the axial coil 50. The signals generated by the Y and Z pickup coils 56, 58 then depend primarily upon the relative displacement of the coil 51 around the axis 22. Because the coil 51 is mounted in fixed relationship to the piercing point 24, the displacement of the point is indicated by the relative magnitude of the respective signals from the respective Y and Z coils as detected by the respective synchronous detectors 68 and 74 and, hence, is indicated on the display 64. This enables the operator to position the tool 16 about its axis by controlling the position of the vanes 26 and thereby cause the tool 16 to advance in a desired direction relative to its axis 22. The feedback by way of the controller circuit 80 is not used in this mode, as the signal from the X coil 54 is near zero in this mode.

The present invention is useful in a simple form when it is desirable simply to keep the tool on a straight course. This is achieved simply by directing the tool 16 toward the sensing assembly 46 while keeping the outputs picked up by the Y and Z coils 56, 58 nulled. As mentioned above, it is possible to deviate to avoid obstacles and then return to the course. This is facilitated by keeping track of where the tool is at all times. This requires a measurement of the tool advance within the borehole. Although this is indicated to a degree by the power required to maintain constant the output of the X coil 54, it is more accurate to measure x displacement along the borehole more directly by measuring the length of lines 53 fed into the borehole or by a distance indicating potentiometer 84 tied to the tool 16 by a line 86. This provides a signal on a line 88 indicating displacement and incremental displacement of the tool 16 within the borehole. This information, in combination with the signals from the Y and Z coils 56, 58, permits the operator to keep track of the location of the tool at all times.

When distance is kept track of and position is determined, it is possible by more sophisticated electronics to operate with the sensing assembly in the input pit 34, particularly if the tool 16 is kept substantially on the x axis. For example, if the tool is allowed to progress a substantial distance from the desired axis, the angle B becomes significant and a more complicated set of relationships applies than when the size of the angle B is near 0 and its cosine 1. That is, Equation (4) may not be simply approximated. In this case, it will be necessary to continuously develop the position of the tool in order to provide accurate data on its location. In this case, the initial tool orientation is determined by means of the sensor coils. Then the tool is allowed to advance an incremental distance, which is also measured. The new location is then determined based on the initial angle and the incremental amount of progress, an integration process. This process is continuously repeated to allow continuous determination of the position of the tool.

Other modifications of the present invention are also possible. For example, the sensing assembly 46 may be moved from place to place or its orientation charged during boring in order to change course. Also the sensor coils can be located on the tool and the source coils placed in either pit. It is also within the scope of the present invention to provide sensors on the tool 16 for sensing obstacles, hence permitting control of the direction of tool advance to avoid the obstacles.

Other types of boring or drilling systems can be used in conjunction with the present invention, such as hydraulic percussion tools, turbo-drill motors (pneumatic or hydraulic) or rotary-drill type tools. The important aspects of the tool are that it include some motive means and a steering mechanism that can be controlled by control signals from afar.

What is claimed is:

1. A system for boring a bore hole comprising:

a boring tool having a longitudinal tool axis and including a motive means for advancing the tool through the earth and steering means for directing the motion of the tool relative to said tool axis in response to control signals;

axial electromagnetic source means for generating an axial alternating magnetic field directed along an axial source axis;

a sensing assembly remote from said source means and including first and second pickup coils for sensing said alternating magnetic field, each coil of said first and second pickup coils:

being responsive to the change of magnetic flux linked thereby by generating respective electrical signals systematically related thereto, having a respective coil axis, being rigidly mounted in respect to the other coil with the coil axis of said first coil at a substantial angle with respect to the coil axis of said second coil, said coil axes defining a sensing assembly axis substantially normal to both said coil axes, and being balanced in respect to said sensing assembly axis to generate a respective null electrical signal when the lines of magnetic flux at the respective coil are normal to the respective coil axis at said sensing assembly axis;

one and only one of said source means and said sensing assembly being rigidly mounted on said tool;

indicating means responsive to electrical signals generated by respective said first and second pickup coils for indicating the direction of lines of magnetic flux at said sensing assembly relative to said sensing assembly axis, thereby indicating the attitude of said source means relative to said first and second pickup coils; and control means for providing control signals for controlling said steering means.

2. A system according to claim 1 wherein said source means is mounted on said tool.

3. A system according to claim 2 wherein said sensing assembly is disposed in a pit in advance of said tool.

4. A system according to claim 3 wherein said sensing assembly includes a third pickup coil having a coil axis substantially coincident with said sensing assembly axis for sensing the component of said axial alternating magnetic field extending in the direction of said sensing assembly axis by generating a respective third electric signal systematically related thereto, said control system further comprising feedback means responsive to said third electrical signal for controlling said axial electromagnetic source means to generate said axial alternating magnetic field at such amplitude as to keep said third electrical signal substantially constant irrespective of the distance between said source means and said sensing assembly.

5. A system according to claim 2 wherein said sensing assembly includes a third pickup coil having a coil axis substantially coincident with said sensing assembly axis for sensing the component of said axial alternating magnetic field extending in the direction of said sensing assembly axis by generating a respective third electric signal systematically related thereto, said control system further comprising feedback means responsive to said third electrical signal for controlling said axial electromagnetic source means to generate said axial alternating magnetic field at such amplitude as to keep said third electrical signal substantially constant irrespective of the distance between said source means and said sensing assembly.

6. A system according to claim 1 wherein said sensing assembly includes a third pickup coil having a coil axis substantially coincident with said sensing assembly axis for sensing the component of said axial alternating magnetic field extending in the direction of said sensing assembly axis by generating a respective third electric signal systematically related thereto, said control system further comprising feedback means responsive to said third electrical signal for controlling said axial electromagnetic source means to generate said axial alternating magnetic field at such amplitude as to keep said third electrical signal substantially constant irrespective of the distance between said source means and said sensing assembly.

7. A system for boring a bore hole comprising:

a boring tool having a longitudinal tool axis and including motive means for advancing the tool through the earth;

axial electromagnetic source means for generating an axial alternating magnetic field directed along an axial source axis;

a sensing assembly remote from said source means and including first and second pickup coils for sensing said alternating magnetic field, each coil of said first and second pickup coils:

being responsive to the change of magnetic flux linked thereby be generating respective electrical signals systematically related thereto, having a respective coil axis, being rigidly mounted in respect to the other coil with the coil axis of said first coil at a substantial angle with respect to the coil axis of said second coil, said coil axes defining a sensing assembly axis substantially normal to both said coil axes, and being balanced in respect to said sensing assembly axis to generate a respective null electrical signal when the lines of magnetic flux at the respective coil are normal to the respective coil axis at said sensing assembly axis;

one and only one of said source means and said sensing assembly being rigidly mounted on said tool;

indicating means responsive to electrical signals generated by respective said first and second pickup coils for indicating the direction of lines of magnetic flux at said sensing assembly relative to said sensing assembly axis, thereby indicating the attitude of said source means relative to said first and second pickup coils;

means for determining the advance of the tool in said bore hole by producing displacement signals systematically related thereto;

incremental displacement means, responsive to incremental changes in said displacement signals and to said attitude as indicated by said indicating means, for producing incremental movement signals indicating incremental movement of said tool; and integrating means responsive to said incremental movement signals for locating said tool in said bore hole.

8. A system according to claim 7 wherein said source means is mounted on said tool.

9. A system according to claim 8 wherein said sensing assembly includes a third pickup coil having a coil axis substantially coincident with said sensing assembly axis for sensing the component of said axial alternating magnetic field extending in the direction of said sensing assembly axis by generating a respective third electric signal systematically related thereto, said control system further comprising feedback means responsive to said third electrical signal for controlling said axial electromagnetic source means to generate said axial alternating magnetic field at such amplitude as to keep said third electrical signal substantially constant irrespective of the distance between said source means and said sensing assembly.

10. A system according to claim 7 wherein said sensing assembly includes a third pickup coil having a coil axis substantially coincident with said sensing assembly axis for sensing the component of said axial alternating magnetic field extending in the direction of said sensing assembly axis by generating a respective third electric signal systematically related thereto, said control system further comprising feedback means responsive to said third electrical signal for controlling said axial electromagnetic source means to generate said axial alternating magnetic field at such amplitude as to keep said third electrical signal substantially constant irrespective of the distance between said source means and said sensing assembly.

11. A system according to anyone of claims 1 to 10 including transverse electromagnetic source means for generating a transverse alternating magnetic field substantially at said axial source means having a transverse source axis transverse of said axial source axis, and means for energizing said axial electromagnetic source means and said transverse electromagnetic source means alternatively, whereby said means for indicating indicates the rotational position of said tool about said tool axis.

* * * * *